US006309139B1

(12) United States Patent
Tran-Quoc-Nam

(10) Patent No.: US 6,309,139 B1
(45) Date of Patent: Oct. 30, 2001

(54) MANHOLE WITH EXTENSION WINGS

(75) Inventor: John Tran-Quoc-Nam, Scarborough (CA)

(73) Assignee: Wilkinson Heavy Precast Limited, Dundas (CA)

( * ) Notice: Subject to any disclaimer, the term of this patent is extended or adjusted under 35 U.S.C. 154(b) by 0 days.

(21) Appl. No.: 09/520,039

(22) Filed: Mar. 7, 2000

Related U.S. Application Data

(60) Provisional application No. 60/123,368, filed on Mar. 8, 1999.

(51) Int. Cl.[7] ..... E02B 11/00; E02D 29/12

(52) U.S. Cl. ..... 405/38; 405/40; 405/41; 405/53; 404/25; 404/2; 52/20; 52/21

(58) Field of Search ..... 405/36, 40, 41, 405/38, 52, 53; 52/20, 21; 404/2, 4, 25, 26

(56) References Cited

U.S. PATENT DOCUMENTS

| | | | | |
|---|---|---|---|---|
| 3,930,372 | * | 1/1976 | Norman | 52/21 |
| 4,023,590 | * | 5/1977 | Harris et al. | 52/21 |
| 4,102,088 | * | 7/1978 | Keller et al. | 52/20 |
| 4,253,282 | * | 3/1981 | Swartz | 52/20 |
| 4,275,757 | * | 6/1981 | Singer | 52/20 |
| 4,472,911 | * | 9/1984 | Jooris et al. | 52/20 |
| 4,540,310 | * | 9/1985 | Ditcher et al. | 52/20 |
| 4,619,555 | * | 10/1986 | Skinner et al. | 405/154 |
| 4,621,941 | * | 11/1986 | Ditcher et al. | 404/26 |
| 5,386,669 | * | 2/1995 | Almeida | 52/19 |
| 5,490,744 | * | 2/1996 | McNeil | 405/303 |
| 5,511,904 | * | 4/1996 | Van Egmond | 405/52 |
| 6,074,130 | * | 6/2000 | Duran | 405/53 |

* cited by examiner

*Primary Examiner*—Thomas B. Will
*Assistant Examiner*—Alexandra K. Pechhold
(74) *Attorney, Agent, or Firm*—Edward H. Oldham

(57) ABSTRACT

A manhole for a storm sewage system comprising a structure having at least two outwardly extending substantially vertical flat panels projecting outwardly from the exterior surface a predetermined distance on opposite sides of the base portion of the manhole.

8 Claims, 2 Drawing Sheets

MANHOLE WITH EXTENSION WINGS

This appl. claims benefit of Prov. No. 60/123,368 filed Mar. 8, 1999.

FIELD OF INVENTION

This invention relates to a device which is applicable to storm water filtration and exfiltration systems wherein a storm sewer system is designed to return at least a portion of the runoff water into the soil during periods of rainfall.

BACKGROUND OF THE INVENTION

For many years, the primary object of a storm sewer system in urban and suburban developments has been to collect runoff water in catch basins, etc., duct the water from catch basins into a storm sewer pipe and provide suitable ducting to lead the captured water to a suitable dumping site such as a lake, river or ocean. Little thought has been given to returning some or all of the runoff water to the soil through which the storm sewer system passes.

Because of increasing public awareness of the gradual depletion of the underwater aquifer, more and more attention has been given to the conservation and replenishment of the underground aquifer.

To this end, extensive studies have been done to determine possible methods of restoring the aquifers in areas of urban development which are serviced by storm sewer systems which, until recently, have functioned in the classical manner of ducting all the runoff water into some type of sink.

Such a study was carried out in the city of Etobicoke and is reported in publication ISBN 0-7778-72854 entitled Post-Construction Evaluation of Stormwater Exfiltration and Filtration Systems by A. M. Candaras Associates Inc. (Project No. 9321) under publication PIBS 3622E (Queens Printer for Ontario 1997).

This study details methods of controlling runoff and the introduction of storm sewage effluent into the soil surrounding a storm sewer installation. In the system studied, a conventional storm sewer system is augmented by connecting a parallel drainage system comprising a system of perforated drainage pipes located in a sewer trench just below the standard storm sewer pipe used (previously) to carry the total runoff water. The sewer trench, in which the perforated pipes are located, is purposely filled with stone aggregate. The perforated pipes and the storm sewer pipe are connected into a conventional manhole system, so that the storm sewer pipe is located in the sewer trench a predetermined distance above the perforated drainage pipes. The perforated pipes are plugged at each connected downstream manhole to prevent the passage of the runoff water contained in the perforated pipes into the downstream manhole and to encourage the water in the perforated pipes to flow into the stone aggregate surrounding the perforated pipes.

At times of substantial runoff events, it will be found that the perforated pipe system may not be able to contend with the entire runoff and as the water in the manholes builds up to the storm sewer outlets, the standard storm sewer begins to conduct the excess runoff to the usual sink.

SUMMARY OF THE INVENTION

A modified manhole will be described which will prove invaluable to the success of returning the water contained in the perforated pipe-stone aggregate system into the underground aquifer. Each manhole in the runoff recovery system is provided with a pair of extension wings which will function as a dam in the storm sewer excavation trench where the stone aggregate is located. The extension wings are preferably an integral part of the manhole or they may be accessories readily attachable to the existing manhole structure.

PERTINENT PRIOR ART

U.S. Pat. No. 5,511,904 Apr. 30, 1996 Van Egmond

This patent describes a funnel structure for filtering and discharging storm sewage water into an underground aquifer by providing a conductive path for the escape of water through a sump provided in the bottom of the manhole. The sump is basically an open pipe which allows filtered sewage water to flow into the soil beneath the manhole. Filtration is provided by a sack filled with suitable filtering materials which is placed in the sump where the sewer water enters the sump. In this manner, water is encouraged to enter the soil beneath the manhole.

This patent, which requires a minimum of expense to install in new or existing installations, will function to return a portion of the runoff water to the soil surrounding the base of a manhole, requires substantial maintenance in order to periodically remove the filter sacks from the manhole sumps when they become clogged through use.

DESCRIPTION OF THE PREFERRED EMBODIMENT

Figure 1:
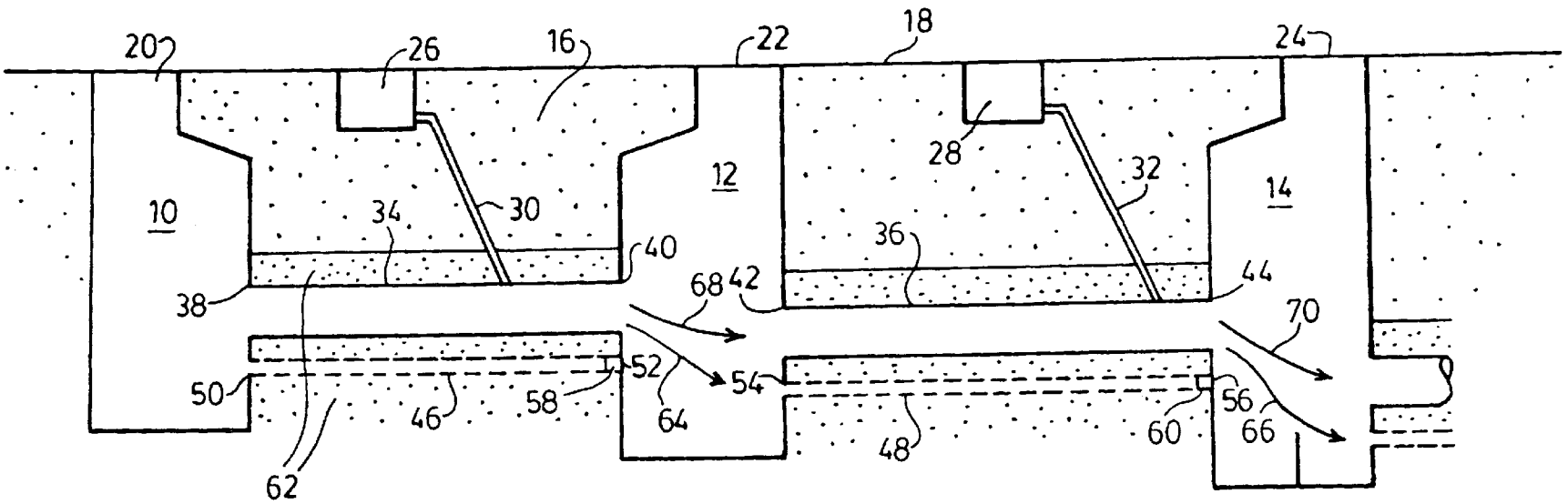
FIG. 1 is a sectional elevation of a sewer trench of an exfiltration sewer system.

FIG. 1 is an elevational sectional view of a sewer water ground recovery system with exfiltration means. FIG. 1 shows three manholes, 10, 12, 14 located in soil 16. A roadway having surface 18 is provided with sewer manhole covers 20, 22 and 24 on manholes 10, 12 and 14 respectively and a pair of catch basins 26 and 28 are shown in surface 18.

Catch basins 26 and 28 have standard sumps or they may be provided with goss traps. The catch basins 26 and 28 are provided with drainage pipes 30 and 32 which are connected into sewer pipes 34 and 36.

Sewer pipes 34 and 36 are sloped and connected into manholes 10, 12 and 14 in a standard manner at locations 38, 40, 42 and 44. In addition to the storm sewer pipes, each manhole is provided with connections to a plurality of perforated pipes such as 46 and 48 which are connected into manholes 10, 12 and 14 at locations 50, 52 and 54, and 56 respectively. The perforated pipes are carefully sealed into manholes 12 and 14 at locations 52 and 56 and each of the perforated pipes 46 and 48 are provided with plugs 58 and 60 at these locations.

The sewer pipes 34 and 36 and the perforated pipes 46 and 48 are laid in a bed of stone aggregate 62 which is laid to a predetermined depth in the sewer system and usually the entire width of the excavation trench in which the storm sewer is located. The trench is usually filled with soil 16 above the stone aggregate 62 and is compacted according to regulations.

The entire stone aggregate bed 62 may be encased in a suitable geotextile fabric (not shown) to provide the final exfiltration required by regulations established by the governing sewer authority in which the system is installed.

The system functions as follows:

Rainfall which falls on surface 18 and is collected in catch basins 26 and 28. When the rainfall has reached a predetermined level, it exits via catch basin pipes 30 and 32 to storm sewer pipes 34 and 36. The collected water now flows in sewer pipes 34 and 36 to manholes 12 and 14 respectively where it falls into the bottom of the manholes 12 and 14. The runoff water then builds up in the manholes until it reaches the level of installation of the perforated pipes 46 and 48 at 50 and 54. Water now begins to flow into perforated pipes 46 and 48 as shown by arrows 64 and 66 and into the stone aggregate 62 (water dissipation system). The runoff water which flows through the pipes 46 and 48 gradually escapes through the perforations in pipes 46, 48 filling the stone aggregate 62. Water cannot flow from manhole 10 to manhole 12 or from manhole 12 to manhole 14 through the plurality of perforated pipes 46 and 48 because of plugs such as 58 and 60 installed at the downstream ends thereof.

Then the groundwater runoff in pipes 46 and 48 is gradually dissipated in the soil surrounding the stone aggregate 62.

If the runoff event is intense, the perforated pipes 48, 48 may not have sufficient capacity to dissipate the entire runoff water in the stone aggregate 62 as fast as the catch basins 26, 28 transfer runoff water into the sewer pipes 34, 36. In this event, water continues to build in manholes 10, 12 and 14 until it reaches the level of the outgoing sewer pipes 34 and 36 at locations 38, 42 whereupon water flows in a conventional manner as indicated by arrows 68 and 70 through the storm sewer pipes such as 34 and 36 into the ultimate water disposal area or sink. Of course the sewer pipes will perform this same function when the stone aggregate 62 becomes waterlogged as would occur during a long, heavy and persistent rainfall.

It will be seen that the system functions to produce a water head in the perforated pipes 46 and 48 between the existing manholes 10, 12 and 14. The head produced causes water to be introduced into stone aggregate 62 and establish hydraulic pressure in the stone aggregate 62 as the water levels in the manholes 10 and 12 increase. The resulting pressure will assure that the runoff water in the trench (absent some damming means) will establish a flow in the stone aggregate 62 along the trench until it reaches the disposal site.

Because the stone aggregate 62 is the sewer trench provides an excellent conduit for the storm water delivered thereto by the perforated piping system to flow toward the ultimate sink, it has been found that a specially constructed manhole will provide an effective dam which prevents the unrestricted flow of storm water at each manhole location. Without such a restriction it will be found that a diminished amount of the runoff water will be dissipated into the soil surrounding the sewer trench, and in addition, soil surrounding the sewer trench may be carried by the unrestricted water flow in the stone aggregate, leading to erosion of soil above and around the trench and leading to the ultimate failure of the road above the trench.

Figure 2:
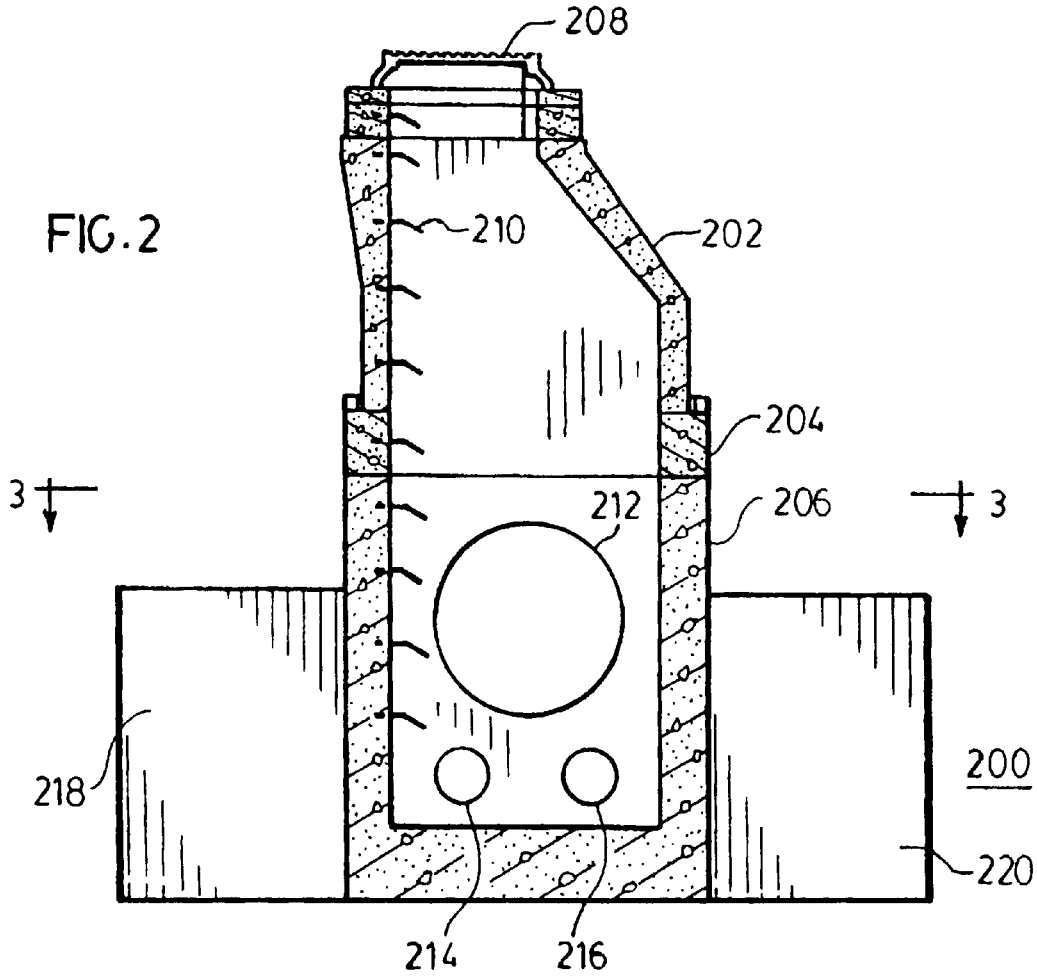
FIG. 2 is a sectional view of a manhole of this invention.
Figure 3:
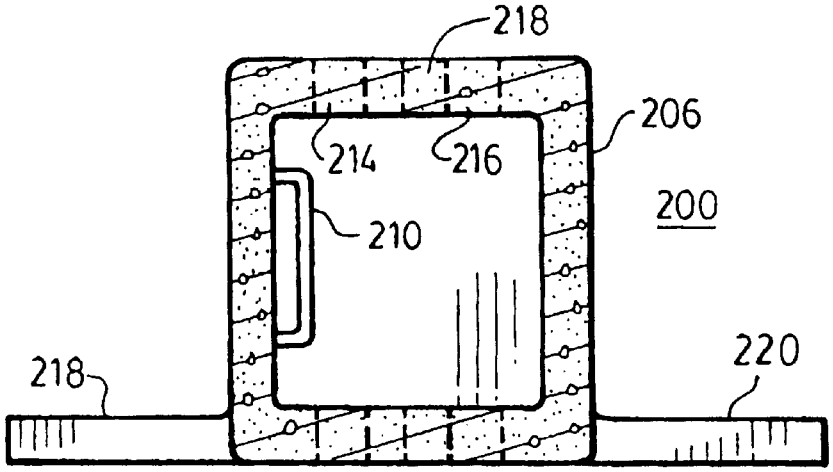
FIG. 3 is a sectional view along the section line 3—3 of FIG. 2.

The modified manhole shown in FIGS. 2 and 3 will prevent the unobstructed water flow in the stone aggregate 62 is the subject of this invention.

FIG. 2 shows a sectional elevational view of a manhole structure 200 having the structure which illustrates this invention. In this illustration, the manhole 200 comprises three components: a tapered top section 202; and in this instance an adapter 204 and an exfiltration base 206. The manhole is supplied with a standard cover 208 and a ladder 210 in the interior thereof.

The manhole is provided with Knock out access holes 212, 214 and 216 for the accommodation of storm sewer pipe and perforated pipes such as 46 and 48 of FIG. 1 which will be subsequently connected into the manhole 200.

The base 206 of manhole 200 is constructed to have a pair of outwardly extending wings or extensions in the form of vertically extending flat panels 218 and 220, which in this instance, are integrally attached to the base 206 of manhole 200.

FIG. 3 shows a sectional plan view of the base 206. The panels 218 and 220, in this instance, are integrally cast into the base 206. The length and width of the panels 218 and 220 may be tailored to the dimensions of the sewer trench and the depth of stone aggregate in the trench.

It will be seen that the panels 218 and 220 are made to extend the entire width of the excavated trench for the sewer installation and, hence, the resulting structure effectively provides a dam for the bypass of water which in the absence thereof would flow around and past the manhole 200 in the stone aggregate such as 62 in FIG. 1.

In this illustration, the panels are shown as being integral with the manhole 200 as will usually be the case. The most efficient construction for the "dam manhole" is of course precast construction where the complete unit may be delivered to the construction site. In some instances it may be necessary or more convenient to manufacture the panels separately and subsequently install the panels as "add on" accessories to the manhole. In new installations, it may be convenient to have a collar which surrounds the manhole into which the manhole base 206 fits and which includes the extensions as projections from the collar. In any event, the panels must seal at the manhole to prevent bypass of the water in the stone aggregate around the manhole.

It will be seen that the panels 218 and 220 will improve the dissipation and absorption of water in the soil surrounding the sewer trench by the increase in head pressure of the water in the stone aggregate provided by the blockage produced by manhole panels 218 and 220. Subsidence of the fill above the stone aggregate as might occur due to the continuous unobstructed water flow in the trench of stone aggregate is largely avoided. The capacity of the entire sewage system has been increased because of the ability of the system to introduce a generous amount of water back into the soil in the immediate vicinity of the sewer trench.

While rectangular or square manholes have been illustrated in the disclosure herein, it will be understood that other shapes of manholes will function as a dam for the water flowing in the aggregate of the sewer trench. The manhole may be of single unit or multi unit construction.

While other methods of providing obstructions to the water flow in the sewer trench aggregate will appear as obvious substitutions for applicant's "dam manholes " applicant wishes to limit the scope of protection by the following claims.

What is claimed is:

1. A manhole comprising a hollow precast structure in the form of a tank having an interior and exterior surface, comprising a base portion and an upper manhole portion affixed to said base portion, said base portion having substantially vertical walls extending a predetermined distance below said manhole portion, said base portion having at least two outwardly extending substantially vertical flat panels projecting outwardly from the exterior surface a predetermined distance on oposite sides of said base portion.

2. A manhole as claimed in claim 1 wherein the manhole has a base portion of rectangular cross sectional shape from which said vertical flat panels extend.

3. A manhole as claimed in claim 2 wherein said manhole is provided with access openings for receiving and delivering storm water from and to a sewer system and wherein additional outlet means is provided in said manhole to allow storm water to flow out of said manhole into storm water dissipation means.

4. A manhole as claimed in claim 1 wherein said hollow upper manhole portion is of a somewhat conical shape and, said base portion is of hollow rectangular shape from which said flat panels extend.

5. A manhole as claimed in claim 4 wherein said manhole is provided with access openings for receiving and delivering storm water from and to a sewer system and wherein additional outlet means is provided in said manhole to allow storm water to flow out of said manhole into storm water dissipation means.

6. A manhole comprising a hollow precast concrete vault having a top and a bottom, and having access openings for at least a storm sewer inlet, and a storm sewer outlet therein, an access opening in the top of said vault for inspection and cleaning said vault, said vault having two outwardly extending vertical flat panels of predetermined dimensions projecting from an exterior surface on opposite sides of said vault.

7. A manhole as claimed in claim 6 wherein said manhole includes at least two additional access openings, a first located at a level below said sewer inlet and a second at a level below said sewer outlet.

8. A manhole as claimed in claim 7 wherein water dissipation conduit means is connected to said first and second access openings.

* * * * *